US006092586A

United States Patent [19]

Schönbeck

[11] Patent Number: 6,092,586

[45] Date of Patent: Jul. 25, 2000

[54] METHOD AND ARRANGEMENT FOR PRODUCING HOT-ROLLED STEEL STRIP

[75] Inventor: Joachim Schönbeck, Düsseldorf, Germany

[73] Assignee: Mannesmann AG, Düsseldorf, Germany

[21] Appl. No.: 09/155,367

[22] PCT Filed: Mar. 25, 1997

[86] PCT No.: PCT/DE97/00683

§ 371 Date: Sep. 28, 1998

§ 102(e) Date: Sep. 28, 1998

[87] PCT Pub. No.: WO97/36699

PCT Pub. Date: Oct. 9, 1997

[30] Foreign Application Priority Data

Mar. 28, 1996 [DE] Germany ..... 196 13 718

[51] Int. Cl.[7] ..... B21B 1/46; B21B 13/22; B22D 11/12

[52] U.S. Cl. ..... 164/476; 164/417

[58] Field of Search ..... 164/476, 417

[56] References Cited

U.S. PATENT DOCUMENTS

| | | | |
|---|---|---|---|
| 4,793,401 | 12/1988 | Matsuoka et al. | 164/417 X |
| 5,113,678 | 5/1992 | Mannaka et al. | 164/476 X |
| 5,634,257 | 6/1997 | Kajiwara et al. | 164/417 X |

*Primary Examiner*—J. Reed Batten, Jr.
*Attorney, Agent, or Firm*—Cohen, Pontani, Lieberman & Pavane

[57] ABSTRACT

Hot rolled steel strip is produced from continuously cast semi-finished steel in directly successive work steps, in which, after conversion of the molten steel into continuously cast semi-finished steel in a stationary process, the semi-finished steel is fed directly from the continuous casting to a continuous hot rolling mill, without prior separation, and an endless steel strip of any desired thinness is produced at the final rolling temperatures usual in process technology directly from the primary heat, using certain parameters.

16 Claims, 1 Drawing Sheet

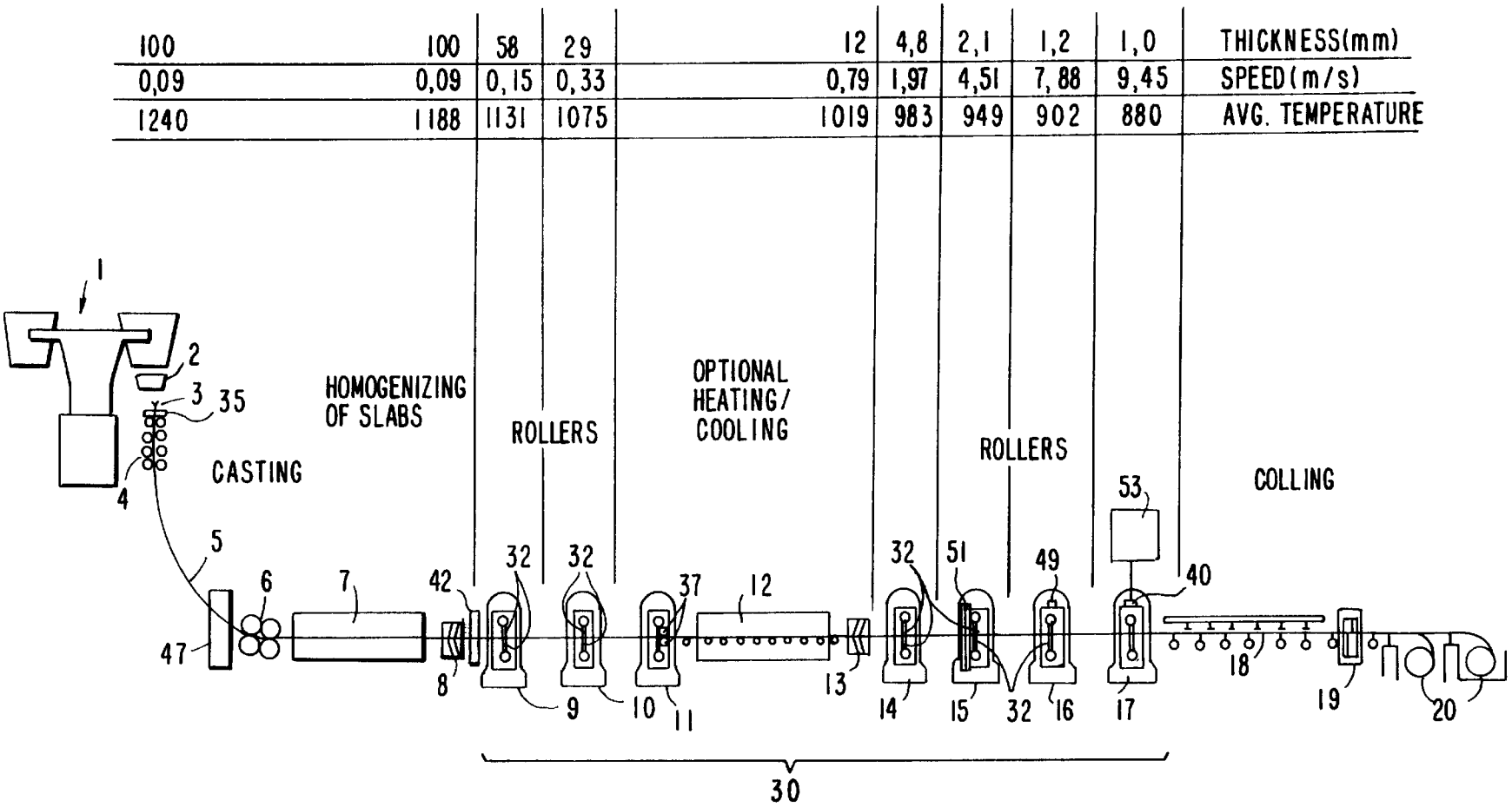
THICKNESS(mm)
SPEED(m/s)
AVG. TEMPERATURE
100
0,09
1240
100
0,09
1188
58
0,15
1131
29
0,33
1075
12
0,79
1019
4,8
1,97
983
2,1
4,51
949
1,2
7,88
902
1,0
9,45
880
CASTING
HOMOGENIZING OF SLABS
ROLLERS
OPTIONAL HEATING/ COOLING
ROLLERS
COLLING
30

METHOD AND ARRANGEMENT FOR PRODUCING HOT-ROLLED STEEL STRIP

BACKGROUND OF THE INVENTION

1. Field of the Invention

The invention relates to a method and an arrangement for producing hot-rolled steel strip from continuously cast semi-finished steel in directly successive work steps.

2. Description of the Prior Art

Steel strip is produced by the deformation of, for example, a cast semi-finished steel, whose weight depends on the coil weight of the finished product, to the desired geometric dimensions in one or more rolling processes. The casting and deformation processes usually occur discontinuously not successively. However, such sequential processes entail long processing times, expensive rolling devices and significant energy losses during processing. Moreover, the discontinuous operation results in output and quality losses.

A number of completely continuous cast-rolling arrangements are mentioned in the literature. However, it is always noted that these configurations are not practically applicable, because the final rolling temperatures needed to establish the desired hot-strip properties cannot be reached with such machines. Due to their low casting speed, the strip would cool so quickly that operation without intermediate heating would be impossible, while operation with the required expensive heating units would not be economical.

An arrangement and a process for the continuous production of strip steel or sheet steel from continuously cast flat products is known from WO-A-89/11363. In this prior art arrangement and process, a continuously cast thin slab, after reduction in a first roll pass, is subjected to induction heating and, directly thereafter, is rolled in a multi-stand finishing train into a strip, which is coiled up at the end of the finishing train. This known solution does not disclose details of temperature control with the goal of always ensuring that the finish-rolling of the strip occurs in the austenitic temperature range.

In producing hot strip, the strict restriction that products be finish-rolled in the austenitic range (≧880° C.) makes the selection of suitable casting parameters especially important. Casting thickness and casting speed play an important role, because they determine the temperature control throughout the entire arrangement during operation.

SUMMARY OF THE INVENTION

The object of the invention is to create a process and an arrangement for producing hot strip from continuously cast semi-finished steel, wherein the hot strip is rolled into a finished product directly from the melt in a continuous, endless process and finish-rolling is carried out in the austenitic temperature range. Further, process heat from the casting process is to be used in producing the hot strip, so that the process and arrangement operate more economically than conventional discontinuous processes and arrangements.

This object is attained in a process for producing hot-rolled steel strip from continuously cast semi-finished steel in directly successive work steps, in which the semi-finished steel produced by a continuous casting machine is fed directly from the continuous casting machine to a continuous hot rolling mill, without prior separation, and an endless thin steel strip is produced at the final rolling temperatures usual in process technology directly from the primary heat, using the following parameters:

A thickness of the semi-finished steel produced by the continuous casting machine $h_o$ [m] and the casting speed $v_c$ [m/min] fulfill the relation:

$$h_o \cdot v_c > 0.487 \text{ m}^2/\text{min},$$

and

The deformation in the rolling mill occurs in at least n deformation steps, whereby it holds that:

$$n = 0.51 + 3.29 \lg_{10}(h_o),$$

wherein $h_o$ is the thickness of the semi-finished steel measured in centimeters (cm).

The strictest restriction in hot-strip production, i.e., the requirement that products be finish-rolled in the austenitic range, can be overcome by a suitable selection of casting parameters (casting thickness $h_o$ and casting speed $v_c$). It has been found that when the product of the slab thickness [m] and the casting speed [m/min] exceeds 0.487 $m^2$/min, it is possible to achieve a successful production process for hot strip with finish-rolling in the austenitic range if, at the same time, the number of deformation steps n in the rolling mill conforms to the formula ($m = 0.51 + 3.29 \lg_{10}(h_o)$).

The invention also proposes an arrangement for implementing the method for producing hot-rolled steel strip from continuously cast semi-finished steel in directly successive work steps, in which the semi-finished steel produced by a continuous casting machine is fed directly from the continuous casting machine to a continuous hot rolling mill, without prior separation, and an endless thin steel strip is produced at the final rolling temperatures usual in process technology directly from the primary heat, using the following parameters:

A thickness of the semi-finished steel produced by the continuous casting machine $h_o$ [m] and the casting speed $v_c$ [m/min] fulfill the relation:

$$h_o v_c > 0.487 \text{ m}^2/\text{min},$$

and

The deformation in the rolling mill occurs in at least n deformation steps, whereby it holds that:

$$n = 0.51 + 3.29 \lg_{10}(h_o),$$

wherein $h_o$ is the thickness of the semi-finished steel in centimeters (cm).

and the rolling mill consists of a number of roll stands (8 to 15) corresponding to the number of deformation steps n, whereby the work roll diameter of all roll stands (8 to 15) is ≦600 mm.

These work roll diameters permit the required deformation of the rolled material needed to achieve the desired temperature control throughout the arrangement.

It is especially advantageous when the work roll diameter, at least in the last two roll stands, is <450 mm. Because the proposed arrangement and process are especially well suited for producing extremely thin hot strip, work rolls with a smaller diameter exhibit better deformation conditions in the roll gap.

According to another feature of the invention, a compensation line to improve temperature homogeneity in the slab is provided between the casting machine and the rolling mill for the purpose of achieving an even temperature over the entire cross-section of the semi-finished steel. Such a compensation line can comprise a compensation furnace of the known type, in which heat can be supplied to the slab as needed. Alternatively, the compensation line can comprise a covered roll table of known design or a covered roll table in conjunction with an induction furnace. The induction furnace may be arranged in front of or behind the roll table.

According to another feature of the invention, for the purpose of further temperature control of the strip passing through the rolling mill, heating and/or cooling aggregates are provided between two or more roll stands to establish the desired temperature curves of the strip during processing. By suitably controlling these heating and/or cooling aggregates, any desired temperature curve may be established in the arrangement, so that the prerequisites for diverse ferritic rolling processes can be met.

According to an embodying feature of the invention, the casting machine is equipped with an automatic strand cooling control device that is controlled so that a lowest point of the liquid pool in the continuous casting machine is maintained as close as possible to the end of the continuous casting machine at all times. This maximizes the energy content of the slab entering the rolling mill.

Preferably, devices for positive and negative roll bending are provided in the roll stands of the rolling mill. Such devices can be used to influence the roll profile of the strip during processing in keeping with given circumstances and objectives.

In a further embodiment of the invention, the gripping condition $\alpha<\mu$ (roll angle<friction coefficient) is violated in at least one roll stand. Because the proposed process and arrangement permit a quasi-endless casting and rolling process, it is not necessary to meet the otherwise absolute entry condition of $\alpha<\mu$ for rolling. Only the withdrawal condition of $\alpha<\mu$, which guarantees that the rolling process is maintained, must be fulfilled. The possibility of violating the entry condition leads to considerable technical and economic advantages, because work rolls with a smaller diameter can be used. As a result, roll force and roll moment decline. This leads to smaller and lighter roll stands as well as to smaller main drives.

Furthermore, at least the main drive of one roll stand is regulated by a minimal tension control device. This is advantageous in applications in which large roll moments and large rolled material thicknesses occur, such as the proposed process. In this way, the expensive installation of a looper between roll stands can be avoided.

Finally, in a completion of the invention, a vertical edging roll, with which the edges of the cast semi-finished steel can be edged, is provided in front of the first roll stand. The edge geometry and edge quality are improved by means of a vertical pass before the first horizontal stand. In addition, greater reductions can be realized in the first horizontal stand. These advantages result from the shaping and recrystallization of the edges during the edging pass.

BRIEF DESCRIPTION OF THE DRAWINGS

FIG. 1 is a schematic view of an arrangement for producing hot-rolled steel strip according to an embodiment of the present invention.

DETAILED DESCRIPTION OF THE PREFERRED EMBODIMENTS

The single drawing FIG. 1 shows an arrangement according to the invention for producing hot-rolled steel strip with a finished strip thickness of 1.0 mm. The drawing shows a thin slab casting machine having a known ladle rotary tower 1, which feeds, via the distribution launder 2, the mold 3 of a thin slab casting machine. The drawing also shows the guide stand 4 of the thin slab casting machine, followed by the curved part 5 of the thin slab casting machine with a reverse bending unit 6. The temperature of the continuously cast semi-finished steel is homogenized over its cross-section in a compensation furnace 7. A scale washer 8 for the semi-finished steel follows the compensation furnace 7 and is followed directly by the hot-rolling mill with seven four-high roll stands 9 to 11 and 14 to 17. The rolling mill is followed by a run-out table with a cooling device 18, a cross cutting shears 19 and two hot-strip coilers 20. Between the stands 11 and 14, there is a temperature adjustment element 12 for the optional heating or cooling (active and passive) of the strip, as well as a further descaling device 13.

As the upper part of the drawing shows, the semi-finished steel strip leaves the continuous casting mold 3 at a speed $v_c$ of 0.09 m/s and a thickness $h_o$ of 100 mm. The speed $v_c$ and the thickness $h_o$ at which the semi-finished steel strip leaves the continuous casting mold 3 meets the relationship $$h_o \cdot v_c > 0.487 \text{ m}^2/\text{min}. \quad (1)$$

At the end of the curved line 5 of the continuous casting machine, the temperature of the semi-finished strip is 1240° C. The semi-finished steel strip passes through the compensation furnace 7 and the scale washer 8, and its temperature following the scale washer 8 is 1188° C. At this temperature, the semi-finished steel is fed to the first four-high roll stand 9 of a hot rolling mill 30, where its thickness is reduced to 58 mm and, at the same time, its speed rises to 0.16 m/s. The hot roll stand 30 is limited to n number of roll stands according to the following relationship to ensure the austenitic rolling of the steel strip:

$$n = 0.51 + 3.29 \lg_{10}(h_o)$$

The temperature of the semi-finished steel thereby drops to 1131° C. Upon leaving the second roll stand 10, the thickness of the rolled material has been reduced to 29 mm and its speed increased to 0.33 m/s, while the rolled material has cooled further to a temperature of 1075° C. After leaving the roll stand 11, the rolled material thickness is 12 mm and the run-out speed of the strip is 0.79 m/s. After leaving the roll stand 11, the strip enters a temperature control line 12, where its temperature can be increased or lowered, as desired, in accordance with the requirements of the rolling process. Before entering the next roll stand 14, the strip is descaled in the descaling device 13. The strip enters the roll stand 14 at 1018° C.

The rolled material is introduced into the roll stand 15 with a thickness of 4.8 mm and a speed of 1.97 m/s at a temperature of 983° C. By further reduction in the roll stand 15, the thickness of the rolled material is reduced to 2.1 mm, while the speed rises to 4.51 m/s. At a temperature of 949° C., the rolled material enters the roll stand 16, where the thickness of the rolled material reduced to 12 mm and its speed is increased to 7.88 m/s. The rolled material is introduced into the final stand 17 at a temperature of 902° C. and rolled to a final thickness of 1.0 mm. The exit speed is 9.46 m/s at a temperature of 880° C. Thus, the prerequisite is met for austenitic rolling of the steel in question, an St 37. After cooling on the roll table 18, the rolled material is coiled alternately onto one of the two hot-strip coilers 20. After reaching the desired coil weight, the strip is cut by the cross cutting shears 19.

In the preferred embodiment the work rolls 32 of the roll stands 9–11 and 14–17 have diameters that are not greater than 600 mm and at least the final two roll stands 16 and 17 have work rolls with diameters less that 450 mm. Each roll stand also includes devices 37 for positive and negative roll bending, as depicted schematically in FIG. 1 in roll stand 9. At least a main drive 40 of one of the roll stands 9 to 11 and 14 to 17 is controlled via a minimum tension control device 53. The hot-rolling mill 30 may optionally include a vertical edging roll 42 upstream of the first roll stand 9.

In an optional embodiment, the arrangement includes an emergency shears 47 between the continuous casting machine 1 and the hot-rolling mill 30. The roll stands may also include a roll grinding device 49 as schematically depicted on roll stand 16. Finally, the roll stands may include roll changing devices 51, one of which is schematically shown in roll stand 15 for roll changes during operation.

The measures according to the invention consist in producing the strip in a continuous, endless process directly from the melt, with no separation of the preliminary product, i.e., the slab. Only the finished hot strip itself is cut in keeping with the coil weight. As a result, the casting heat in the entire arrangement is completely used for subsequent deformation operations. If the arrangement is suitably adjusted (e.g., the size of the work rolls), an intermediate heating of the slabs or strip is not absolutely necessary. However, it is possible for the final rolling temperature to be influenced by a temperature control line (eating and/or cooling) in the process line.

What is claimed is:

1. A method for producing hot rolled steel strip from continuously cast semi-finished steel, comprising the steps of:

converting molten steel into continuously cast semi-finished steel strip in a stationary continuous casting machine;

feeding the continuously cast semi-finished steel strip directly from the continuous casting machine to a continuous hot-rolling mill such that a thickness $h_o$ in meters of the semi-finished steel strip and a casting speed of $v_c$ in meters per minute are in accordance with the following relationship, $$h_o \cdot v_c > 0.487 \text{ m}^2/\text{min};$$

and producing a final thin strip from said semi-finished steel strip using a primary heat in the semi-finished steel strip from said continuous casting machine by running the semi-finished steel strip through the hot-rolling mill having at least n number of roll stands in accordance with the relationship, $$n = 0.51 + 3.29 \lg_{10}(h_o),$$

where $h_o$ is the thickness in centimeters of the semi finished steel strip.

2. The method of claim 1, further comprising the step of edging the semi-finished steel strip with a vertical edging roll before said step of feeding.

3. An arrangement for producing hot-rolled steel strip, comprising:

a continuous casting machine converting molten steel into a continuously cast semi-finished steel strip and outputting from an output end said semi-finished steel strip such that a thickness $h_o$ in meters of the semi-finished steel strip and a casting speed $v_c$ in meters per minute are in accordance with the following relationship, $$h_o \cdot v_c > 0.487 \text{ m}^2/\text{min};$$

a hot-rolling mill comprising n number of roll stands operatively arranged for directly receiving said continuously cast semi-finished steel strip from said continuous casting machine for producing a thin steel strip from said semi-finished steel according to the relationship, $$n = 0.51 + 3.29 \lg_{10}(h_o),$$

where $h_o$ is the thickness in centimeters of the semi finished steel strip; and each of said n number of roll stands comprising work rolls having diameters not greater than about 600 mm.

4. The arrangement of claim 3, wherein said work rolls of at least a final two of said n number of roll stands comprise diameters less than about 450 mm.

5. The arrangement of claim 3, further comprising a compensation line operatively connected between said continuous casting machine and said hot-rolling mill for improving a temperature homogeneity of said semi-finished steel strip.

6. The arrangement of claim 3, further comprising one of a heating aggregate and a cooling aggregate operatively connected between two of said n number of roll stands for establishing a desired temperature curve of semi-finished steel strip during processing.

7. The arrangement of claim 3, further comprising an automatic strand cooling device operatively connected to said continuous casting machine for positioning a lowest point of a liquid pool of said semi-finished steel strip as near as possible to said output end of said continuous casting machine, independently of said casting speed.

8. The arrangement of claim 3, wherein each of said n number of roll stands comprises devices for positive and negative roll bending of said work rolls.

9. The arrangement of claim 3, wherein at least one of said roll stands violate a gripping condition $\alpha < \mu$, where $\alpha$ is a roll angle and $\mu$ is a friction coefficient.

10. The arrangement of claim 3, wherein each of said roll stands comprises a main drive and said arrangement further comprises a minimum tension control device operatively connected for controlling at least one of said said main drives.

11. The arrangement of claim 3, further comprising a vertical edging roll operatively connected in front of a first of said roll stands.

12. The arrangement of claim 3, further comprising a strip descaling device operatively connected in front of one of said roll stands other than said first roll stand.

13. The arrangement of claim 3, further comprising an emergency shears operatively connected between said continuous casting machine and said hot-rolling mill.

14. The arrangement of claim 3, wherein said semi-finished steel strip comprises a molten core during reduction to said thin steel strip in said hot-rolling mill.

15. The arrangement of claim 3, further comprising a roll grinding device operatively mounted on at least one of said roll stands for compensating for roll wear during long casting periods.

16. The arrangement of claim 3, further comprising roll changing devices operatively mounted on at least one of said roll stands for roll changes during operation.

* * * * *